United States Patent [19]

Wilson

[11] 4,169,455

[45] Oct. 2, 1979

[54] BOWSTRING RELEASE DEVICE

[76] Inventor: Hugh R. Wilson, 10840 SW. 120th St., Miami, Fla. 33176

[21] Appl. No.: 894,823

[22] Filed: Apr. 10, 1978

[51] Int. Cl.[2] ..... F41C 19/00

[52] U.S. Cl. ..... 124/35 A

[58] Field of Search ..... 124/35 R, 35 A, 25, 124/31

[56] References Cited

U.S. PATENT DOCUMENTS

| | | | |
|---|---|---|---|
| 650,411 | 5/1900 | Myers | 124/35 A X |
| 2,417,791 | 3/1947 | Tyszkiewicz | 124/35 A |
| 3,788,299 | 1/1974 | Mathews | 124/35 R |
| 3,898,974 | 8/1975 | Keck | 124/35 A |
| 3,937,206 | 2/1976 | Wilson | 124/35 A |
| 3,998,202 | 12/1976 | Boyko | 124/35 A |
| 4,009,703 | 3/1977 | Cunningham | 124/35 A |

*Primary Examiner*—Richard J. Apley

[57] ABSTRACT

This invention is that of a Bowstring release device for drawing and releasing a bowstring to propel an arrow to the target. The structure is very simple and contains but one moving part. The device consists of a body which is provided with a slot for receiving a bowstring and a semi-disc shaped holding member which intersects the bowstring slot to hold the bowstring in a secured position. A part of the holding member's periphery is cut away to provide an escape area for the bowstring so that when the holding member is moved to a second position, a tensed bowstring is released.

4 Claims, 4 Drawing Figures

BOWSTRING RELEASE DEVICE

1. Field of the Invention

The device is intended for use in archery target shooting and for bowhunting.

2. Description of the Prior Art

Although a number of bowstring release devices have appeared in the past, most of them have been rather complicated in design or if simple, they did not usually provide a positive locking to the bowstring to avoid accidental or premature release. This invention provides a new and novel method of holding and releasing a bowstring, is extremely simple in construction and therefor very inexpensive to manufacture and at the same time it is very reliable and very durable. The hunting regulations of some States do not allow the use of a trigger release aid if the device contains more than one moving part. This device will meet that requirement and add the advantage of using a release aid will be available to those hunting in a State with such requirements. Since the device has only one moving part, only the bowstring is released and no other parts are present to strike against the body of the device and create sound. This provides a very quiet release which is of very great value to the bowhunter.

SUMMARY OF THE INVENTION

It is an object of this invention to provide a new and novel bowstring device that is simple, reliable and very cheap to manufacture.

Another object of this invention is to provide a new bowstring release device that is quick and easy to attach to a bowstring.

A further object of this invention is to provide the simple construction of a single moving part and to provide the very silent release of a bowstring when used for bowhunting.

A BRIEF DESCRIPTION OF THE DRAWINGS

DESCRIPTION OF THE PREFERRED EMBODIMENT

Figure 1:
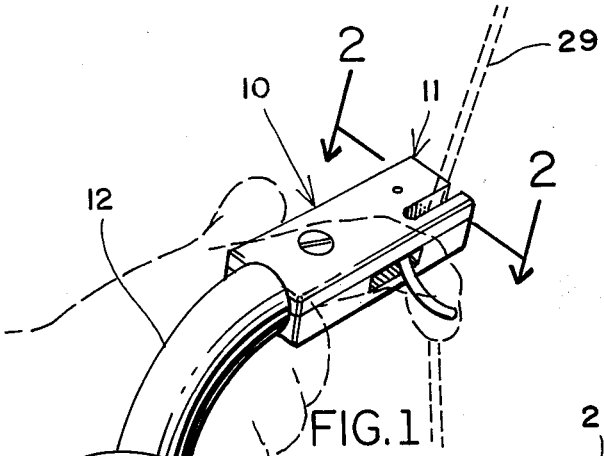
FIG. 1 shows the device as held by the user with the user's hand and a bowstring shown in broken lines.

Referring to the drawings by characters of reference, FIGS. 1–4 illustrate a bowstring release device 10.

Figure 2:
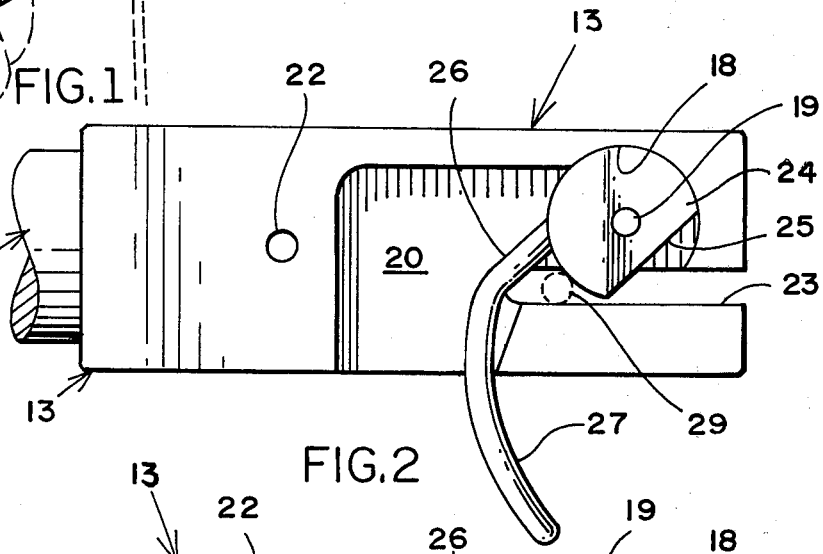
FIG. 2 shows the device with the holding member in the first or cocked position.
Figure 3:
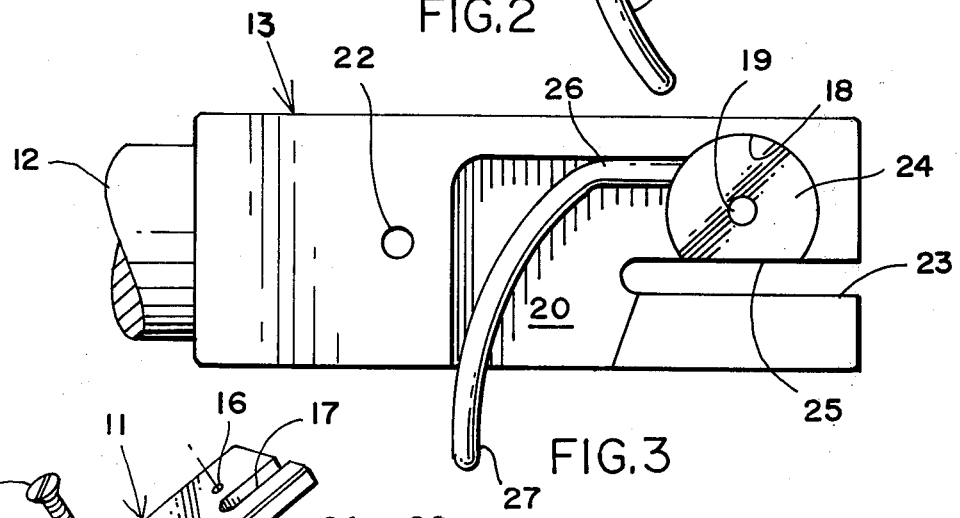
FIG. 3 shows the device with the holding member in the second or uncocked position.
Figure 4:
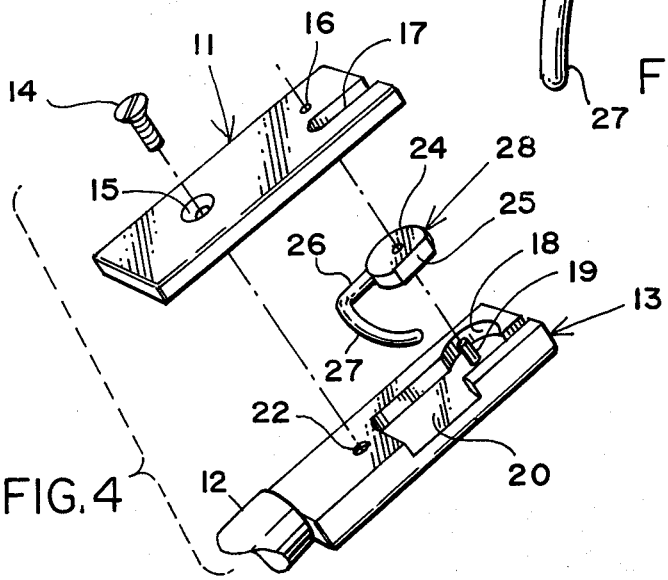
FIG. 4 is an exploded view of the device and it's component parts.

The body 13 is provided with cavities 18 and 20. The cavity 18 contains the holding member 24. The cavity 20 provides clearance for movement of the trigger stem 26. The slot 23 in the body 13 is for receiving a bowstring. The holding member 24 rotates on it's axis on pivot pin 19. The bowstring 29 is placed to the rear of the slot 23 when the device is in a second position as shown in FIG. 3. The periphery of the holding member 24 which intersects the slot 23 will hold the bowstring 29 in a secured position when the holding member 24 is moved to a first position by pressing forward on the trigger stem end 27 as shown in FIG. 2. The trigger stem and the holding member are so formed as to constitute a single moving part. A flat surface 25 cut into the periphery of the holding member 24 provides an escape route for the bowstring 29 when the holding member 24 is moved to a second position by pulling rearward on the trigger stem end 27 as shown in FIG. 3. The body 13 is fitted with a cover 11 which has a hole 16 to align with the pivot pin 19 and a slot 17 to conform with the slot 23 in the body 13. The cover is held in place by the screw 14 which passes through the hole 15 in the cover 11 and into the threaded hole 22 in the body 13. The handle 12 provides a grip for the hand of the user.

OPERATION OF THE DEVICE

To attach the device to a bowstring, the user must pull the trigger stem end 27 to the rear as in FIG. 3. The bowstring is then placed to the rear of the slot 23 and the trigger stem end 27 is pushed forward causing the holding member 24 to close the slot 23 ahead of the bowstring 29 as in FIG. 2. With the bowstring 29 so secured, the user now draws the device to the rear by gripping the handle 12. When the user is prepared to release the bowstring 29, he pulls rearward on the trigger stem end 27 which rotates the holding member 24 from the slot 23 and the bowstring 29 is released.

Although but a few embodiments of the invention have been shown and described, it will be apparent to those skilled in the art that various changes and modifications may be made therein without departing from the spirit of the invention or from the scope of the appended claims.

What is claimed is:

1. A bowstring holding and release device comprising a holding and release means for releaseably engaging a bowstring, said holding and release means comprising a body, notch means mounted on said body, for receiving a bowstring, a rotating holding member mounted on said body for movement between a first position and a second position for holding and releasing a bowstring, respectively, a portion of the periphery of said holding member intersecting said notch means for holding a tensed bowstring when said holding member is in a first position, said bowstring being held in said notch means by the outer peripheral surface of said portion, triggering means mounted on said holding member providing leverage for moving said holding member between said first and second positions, said triggering means and said holding member being so formed as to constitute a single moving part, escape means mounted on said holding member for releasing a bowstring when said holding member is moved from a first position to a second position, whereby when a tensed bowstring is held in said notch means by said portion of the periphery of said holding member when said holding member is in a first position said bowstring is releaseably held and when said holding member is moved from a first position to a second position said portion of the periphery of said holding member is withdrawn from said notch means releasing a tensed bowstring.

2. The structure recited by claim 1 wherein said holding member is semi-cylindrical in shape and pivoted at it's axis.

3. The structure as recited by claim 1 wherein the escape means mounted on said holding member comprises a flat surface on the periphery of said holding member.

4. The structure as recited by claim 1 to include handle means shaped to fit the hand of the user mounted on said holding and release means.

* * * * *